United States Patent [19]

Plester et al.

[11] Patent Number: 4,465,407

[45] Date of Patent: Aug. 14, 1984

[54] FIXING BRIDGE

[75] Inventors: Karl H. Plester, Lünen; Friedrich Eggenstein, Bergkamen-Oberaden; Günter Terhorst, Dülmen, all of Fed. Rep. of Germany

[73] Assignee: Gewerkschaft Eisenhutte Westfalia, Lunen, Fed. Rep. of Germany

[21] Appl. No.: 401,314

[22] Filed: Jul. 23, 1982

Related U.S. Application Data

[63] Continuation of Ser. No. 159,391, Jun. 13, 1980, abandoned.

[30] Foreign Application Priority Data

Jun. 16, 1979 [DE] Fed. Rep. of Germany ..... 2924395

[51] Int. Cl.[3] ..... E21D 23/00

[52] U.S. Cl. ..... 405/299; 299/43; 405/291

[58] Field of Search ..... 405/291, 299, 300, 301; 198/735, 860, 861; 299/31, 33, 43, 64

[56] References Cited

U.S. PATENT DOCUMENTS

| | | | |
|---|---|---|---|
| 3,482,878 | 12/1969 | Floter | 405/299 X |
| 3,556,601 | 1/1971 | Domman et al. | 299/43 |
| 3,842,966 | 10/1974 | Blumenthal et al. | 198/735 |
| 3,957,311 | 5/1976 | Rosler et al. | 299/43 |
| 4,063,782 | 12/1977 | Bahre et al. | 299/43 X |
| 4,245,736 | 1/1981 | Hauschopp et al. | 198/735 |

FOREIGN PATENT DOCUMENTS

| | | | |
|---|---|---|---|
| 516723 | 1/1953 | Belgium | 198/735 |
| 100317 | 1/1957 | Fed. Rep. of Germany | 198/860 |
| 2047520 | 2/1979 | Fed. Rep. of Germany | 299/43 |
| 6511050 | 3/1966 | Netherlands | 198/860 |
| 44954 | 11/1960 | Poland | 198/735 |
| 1195225 | 6/1970 | United Kingdom | 405/299 |

*Primary Examiner*—David H. Corbin

*Attorney, Agent, or Firm*—Thompson, Birch, Gauthier & Samuels

[57] ABSTRACT

A fixing bridge for attachment to the goaf side of a channel section on a scraper-chain conveyor, is provided with connectors for the attachment of anchoring devices. A first connector is provided adjacent to one end of the fixing bridge, and a second connector is provided adjacent to the other end of the fixing bridge. The second connector is vertically off-set with respect to the first connector.

15 Claims, 8 Drawing Figures

FIXING BRIDGE

This application is a continuation of application Ser. No. 159,391, filed June 13, 1980, now abandoned.

BACKGROUND TO THE INVENTION

This invention relates to a fixing bridge for attachment to the goaf side of a scraper-chain conveyor channel section, the fixing bridge being provided with connectors for the attachment of anchoring devices.

Known fixing bridges are made of heavy-gauge metal sheets, and are attached to rails extending along guide plates at the goaf side of the channel sections by means of claws. Such a fixing bridge is provided with a connector in the form of a socket. The socket receives a pivot plug which is associated with a hydraulic anchoring ram of an anchoring arrangement known as a "block anchoring arrangement." The pivot plug is pivotally attached to the ram so that the ram can be articulated in any direction relative to the fixing bridge.

The disadvantage of this type of fixing bridge is its lack of versatility. In particular, a different type of fixing bridge is required if the anchoring arrangement is a "partial longwall anchoring arrangement." Moreover, this type of fixing bridge cannot be connected to the guide plate rails in such a way that the advance mechanisms of the roof support units, which are to be anchored, can be connected either at the centres of the channel sections or at positions off-set from these centres.

The aim of the invention is to provide a fixing bridge which overcomes these disadvantages.

SUMMARY OF THE INVENTION

The present invention provides a fixing bridge for attachment to the goaf side of a channel section on a scraper-chain conveyor, the fixing bridge being provided with connectors for the attachment of anchoring devices, whrein a first connector is provided adjacent to one end of the fixing bridge, and a second connector is provided adjacent to the other end of the fixing bridge, the second connector being vertically off-set with respect to the first connector.

In a preferred embodiment, two, vertically-spaced connectors are provided at said other end of the fixing bridge, each of said second connectors being vertically off-set, in opposite directions, with respect to the first connector. Advantageously, the or each second connector is provided with an aperture, and the first connector is provided with a socket. The first connector can be used for the connection of the anchoring ram of a "block anchoring arrangement," and either of the second connectors can be used for the connection of an anchoring ram of a "partial longwall anchoring arrangement."

Thus, a cylindrical plug (or bush) associated with a ram of a "block anchoring arrangement" can mate with the socket of the first connector, and a chain associated with a ram of a "partial longwall anchoring arrangement" can be connected to the aperture of either of the second connectors.

Preferably, the fixing bridge includes a generally rectangular metal plate, and the first connector is arranged on the central longitudinal axis of the metal plate. In this case, the two second connectors may be symmetrically disposed with respect to the central longitudinal axis of the metal plate. This symmetrical arrangement of the second connectors enables the fixing bridge to be attached to its channel section either way up, and so can be used for either left-hand or right-hand connectors.

Advantageously, two laterally-spaced holders are provided on the fixing bridge between the first connector and the second connector(s). Preferably, each of the holders is constituted by a bore passing through the metal plate. In this case, the fixing bridge may further comprise a bush mounted in one of the holders. The bush engages, in use, in a profiled rail attached to the channel section, and so acts to fix the position of the fixing bridge relative to the channel section.

Conveniently, the bush is provided with an enlarged head portion, and the head portion is provided with a recess. The recess in the head portion of the bush accommodates a nut associated with one of the bolts used to attach the rail to the channel section. The recess in the head portion of the bush may be arranged centrally on the head portion, or it may be off-set from the centre thereof and open out on to the edge of the head portion. This enables the fixing bridge to be used with channel sections of different sizes. It also enables the fixing bridge to be attached to a scraper-chain conveyor at different positions therealong.

The bush may be provided with a spigot extending from its head portion, the spigot carrying a removable fixing ring. The bush can, therefore be detachably secured to the fixing bridge.

The fixing bridge may further comprise means for attaching the fixing bridge to a channel section of a scraper-chain conveyor. Advantageously, the connectors are provided on one side of the metal plate, and the attachment means is provided on the other side of the metal plate. Preferably, the attachment means is constituted by two pairs of claws arranged to grasp a rail attached to a channel section of a scraper-chain conveyor, one pair of claws being fixedly attached to the fixing bridge, and the other pair of claws being detachably fixed to the fixing bridge.

The invention also provides a scraper-chain conveyor channel section having a longitudinally-extending rail attached to one side thereof, and a fixing bridge attached to the rail, wherein the fixing bridge is as defined above. Preferably, the rail is attached to a guide plate fixed to said side of the channel section.

BRIEF DESCRIPTION OF THE DRAWINGS

A conveyor incorporating a fixing bridge constructed in accordance with the invention will now be described, by way of example, with reference to the accompanying drawings, in which.

DESCRIPTION OF PREFERRED EMBODIMENTS

Figure 1:
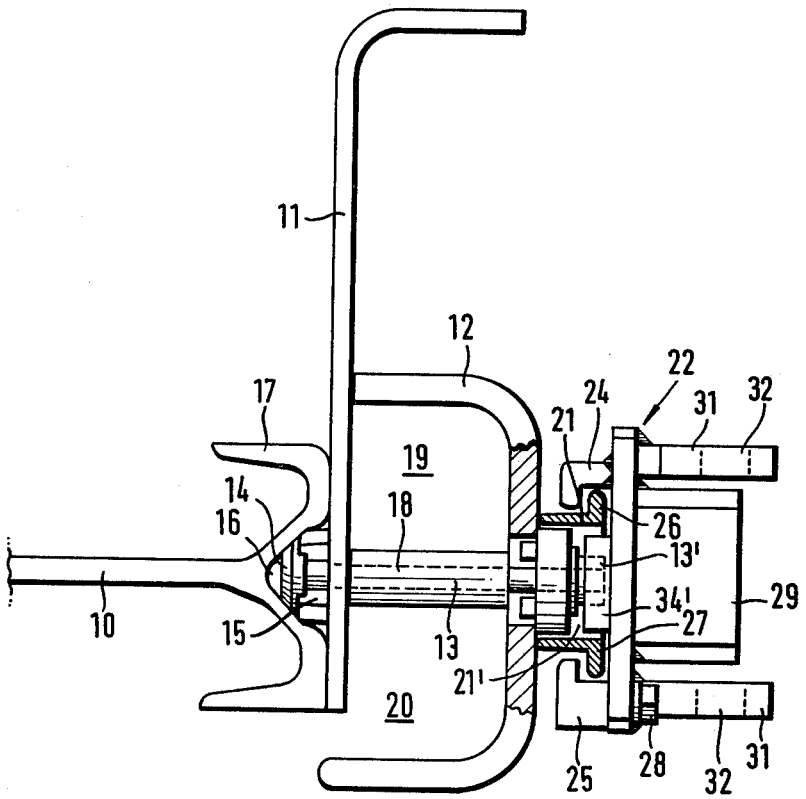
FIG. 1 is a part-sectional end elevation of part of the conveyor and the fixing bridge.
Figure 3:
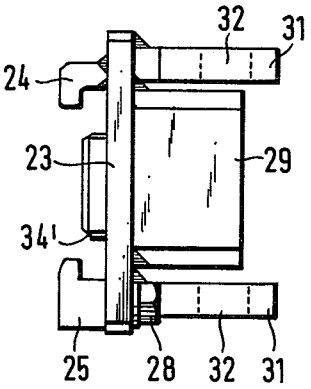
FIG. 3 is an end elevation of the fixing bridge.
Figure 2:
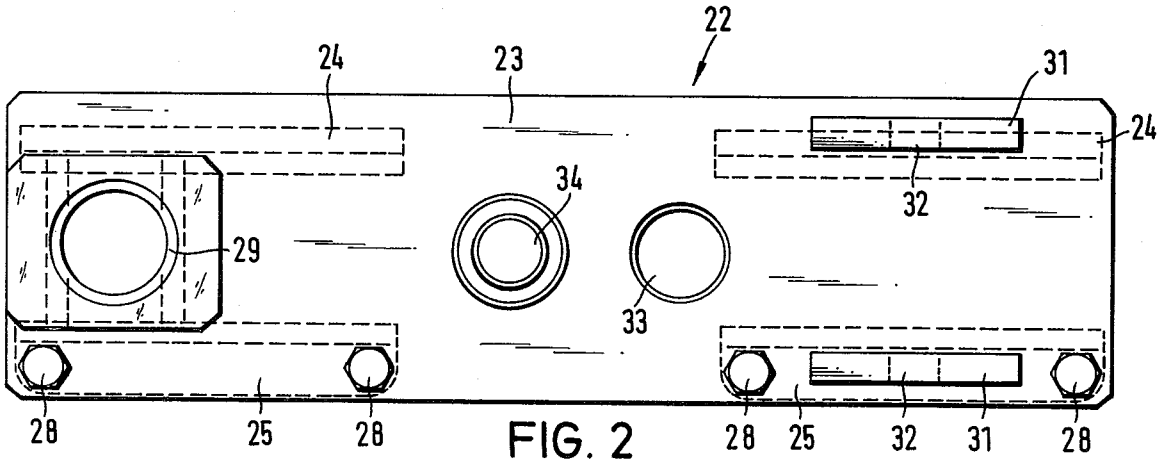
FIG. 2 is a side elevation, looking from the goaf-side of the conveyor, of the fixing bridge.

Referring to the drawings, FIG. 1 shows a channel section 10 of a longwall scraper-chain conveyor. The other channel sections making up the conveyor are identical, so only one channel section will be described in detail. An upstanding spill plate 11 and two U-shaped guide plates 12 are fixed to the goaf side of the channel section 10 by means of bolts 13, the heads 14 of which engage behind spill plate holders 15 welded into a V-shaped recess 16 formed in the goaf-side side wall of the channel section. The bolts 13 pass through holes in spacer plates 18 which divide the interior of the guide plates 12 to define an upper chain duct 19 and a lower chain duct 20. As is well known, an endless plough drive chain (not shown) circulates in the chain ducts 19 and 20, the lower run of the chain being connected to a face side plough (not shown) by a sword plate (not shown), which passes beneath the conveyor.

A rail 21 is welded on to the vertical webs of the two guide plates 12 associated with each channel section 10. The rails 21 provide support for the removable connection of fixing bridges 22 and the advance mechanisms of the roof support units of a roof support assembly positioned at the goaf side of the conveyor (see below).

As the fixing bridges 22 are all identical, only one of them will be described in detail. Thus, each fixing bridge 22 is a heavy-gauge, substantially rectangular, metal plate 23, which is secured to the respective rail 21 by means of two pairs of claws 24 and 25. The claws 24 are welded to the face-side surface of the plate 23 in the upper zone thereof; and embrace, from above, an upstanding flange 26 provided on the rail 21. The claws 25 are detachably secured to the plate 23 by means of bolts 28; and embrace, from below, a flange 27 which depends from the rail 21.

Figure 4:
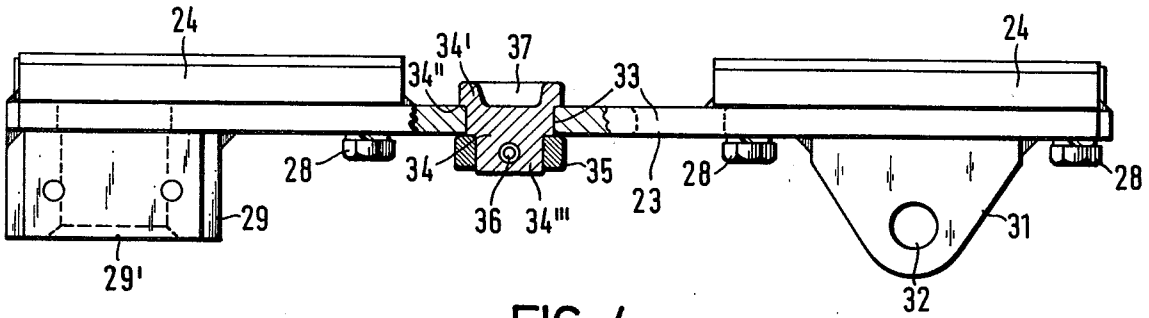
FIG. 4 is a part-sectional plan view of the fixing bridge.

A coupling member 29 is welded to the goaf-side surface of the plate 13 adjacent to one end thereof. The coupling member 29 is provided with a socket 29' which is arranged on the central, longitudinal axis of the plate 23. A pair of vertically-spaced connector plates 31 are welded to the goaf-side surface of the plate 23 adjacent to the other end thereof. As best seen in FIG. 4, the connector plates are generally triangular, and are provided with aligned apertures 32.

Between its coupling member 29 and its two connector plates 31, the plate 23 of each fixing bridge 22 is provided with a pair of longitudinally-spaced holders 33. The holders 33 are arranged on the central longitudinal axis of the plate 23, and are constituted by bores passing through the plate 23. A centering bush 34 can be fitted into either of these holders 33, the head 34' of the bush 34 engaging in a respective recess 21' formed in the rail 21, so that the fixing bridge 22 is held in position with respect to the channel section 10. An annular shoulder 34'' of the head 34' of the bush 34 is supported against the face side surface of the plate 23, and the bush 34 is clamped to the plate 23 by means of a ring 35 which passes round a cylindrical plug portion 34''' of the bush 34, and is detachably secured thereto by means of a heavy-duty pin 36. In this way, the bush 34 is detachably secured to the fixing bridge 22 in either one of the holders 33. A recess 37 is formed, in the head 34' of the bush 34, the recess 37 accommodating the nut 13' associated with one of the bolts 13 (see FIGS. 1 and 7).

Figure 5:
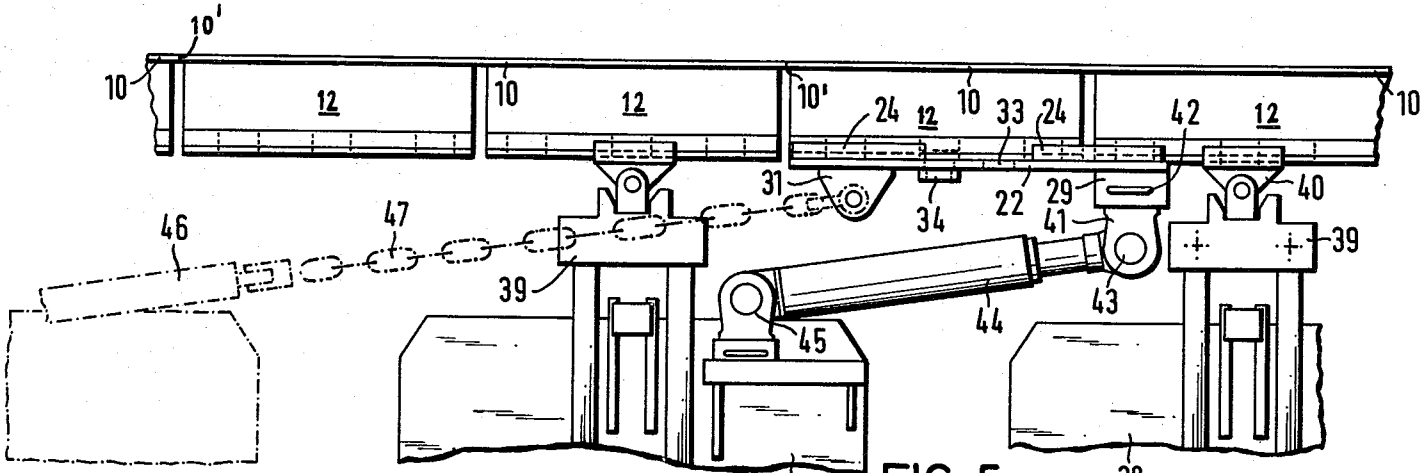
FIGS. 5 and 6 are plan views showing two different ways of using the fixing bridge to attach the conveyor to a roof support assembly positioned at the goaf side thereof.

FIG. 5 is a diagrammatic plan view of part of a scraper-chain conveyor constituted by a plurality of channel sections 10 joined together end-to-end. The joints 10' between adjacent pairs of channel sections 10 are such as to permit limited articulation in any direction whilst resisting tensile forces. Each channel section 10 is provided with a fixing bridge 22 (only one of which is shown in FIG. 5) at the goaf side thereof, each fixing bridge having a length less than that of its channel section. The fixing bridge 22 is attached to its channel section 10, by means of the claws 24 and 25, in such a manner that one of its ends (the left-hand end as seen in FIG. 5) lies flush with the corresponding end of that channel section. An advanceable roof support unit 38 is associated with each of the channel sections 10, the roof support units being positioned side-by-side along the goaf side of the conveyor. Each roof support unit 38 has an advance mechanism 39 which is attached, by means of a pivot joint 40, to the rail 21 of the associated channel section 10. Each pivot joint 40 is off-set from the centre of the associated channel section 10.

A hinge plug 41 is inserted into the socket 29' of the coupling member 29 of each fixing bridge 22, the hinge plugs being held in their sockets by means of a clamp 42, which may be a clamping ring or a shoulder wire. Each hinge plug 41 is connected, via a respective pivot pin 43, to the piston rod of a respective hydraulic ram 44. Each hydraulic ram 44 has its cylinder pivotably connected, by means of a Cardan joint or a universal joint, to the floor sill of the adjacent roof support unit 38. Thus, each ram 44 is pivotably connected between the fixing bridge 22 of one chanel section 10, and the floor sill of the roof support unit 38 associated with the adjacent channel section 10. The rams 44 form part of an anchoring arrangement for the installation, this anchoring arrangement being known as a "block anchoring arrangement."

FIG. 5 also shows, in dash-dot lines at the left-hand side thereof, another form of anchoring arrangement known as a "partial longwall anchoring arrangement." In this case, an anchoring ram 46 is connected to the upper connector plate 31 of the fixing bridge 22 by means of a chain 47. The chain 47 passes over the advance mechanism 39 of a roof support unit 38 associated with a channel section 10 positioned between the two channel sections 10 associated respectively with the anchoring ram 46 and the fixing bridge 22. This is known as a right-hand connection, as the chain 47 connects one roof support unit 38 to the channel section 10 of another roof support unit positioned to the right of the first roof support unit. It is essential that the chain 47 is upwardly angled, and so it is essential that the chain is connected to the fixing bridge 22 at a point above its central longitudinal axis. The provision of two, vertically-spaced connector plates 31 enables the entire fixing bridge 22 to be turned through 180° so that the other connector plate 31 can be used for a left-hand connection. Thus, the fixing bridge 22 is extremely versatile in that it can be used for both right and left-hand connections of a "partial longwall anchoring arrangement," as well as for a "block anchoring arrangement."

Figure 6:
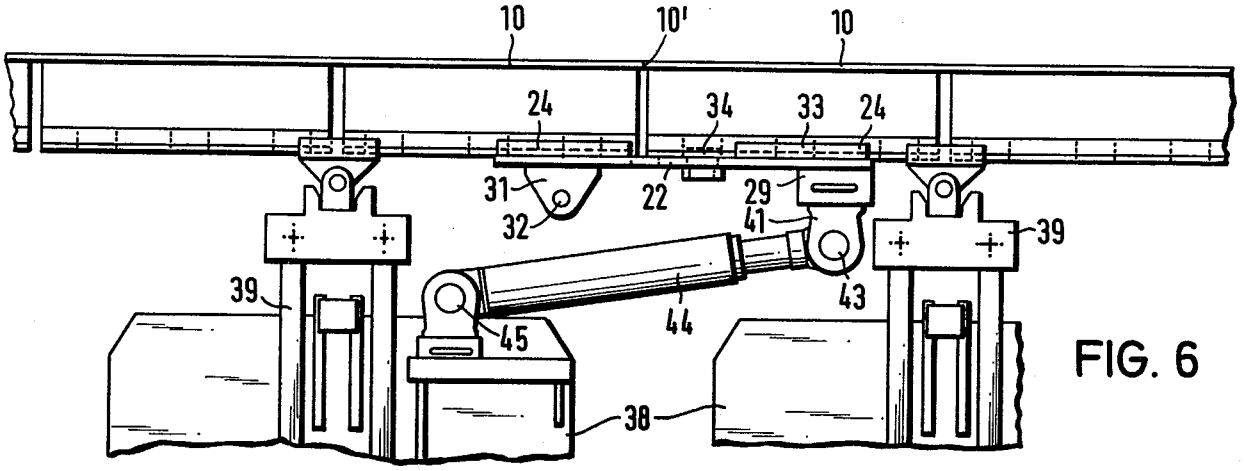

FIG. 6 is a similar view to that of FIG. 5, but shows a modified arrangement, in which each fixing bridge 22 (only one of which is shown) is attached to the rails 21 on the goaf side of the conveyor in such a manner that it bridges the joint 10' between a pair of adjacent channel sections 10. In this case, the advance mechanisms 39 of the roof support units 38 are attached to the rails 21 at the centres of the associated channel sections 10. Here again, though, the fixing bridges can be used for both right and left-hand connections of a "partial longwall anchoring arrangement," as well as for a "block anchoring arrangement."

Figure 7:
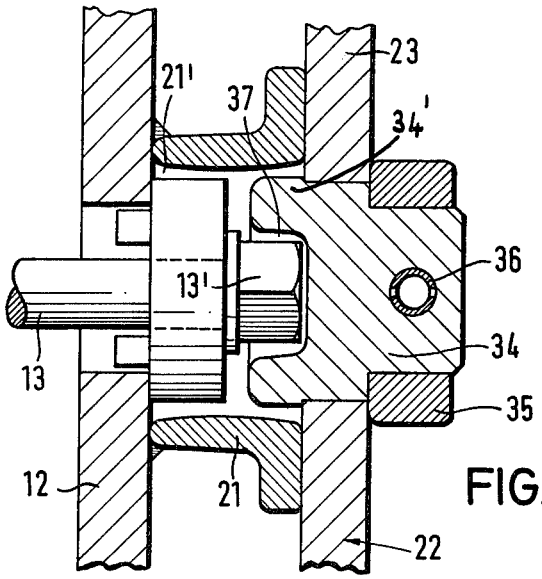
FIGS. 7 and 8 are respectively enlarged cross-sectional views of the fixing bridge of FIGS. 1 to 6, and of a modified fixing bridge, each being shown attached to the goaf side of a conveyor.
Figure 8:
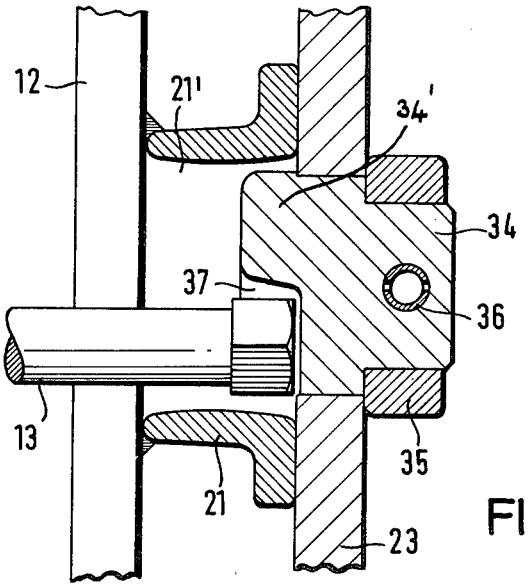

FIG. 7 is an enlarged view showing how one of the nuts 13' is accommodated in the recess 37 formed centrally in the head 34' of the respective bush 34. Where the bolts 13 are off-set relative to the rail 21, each of the bushes 34 is modified, as shown in FIG. 8, so that its recess 37 is off-set from the central longitudinal axis of the bush. As shown in FIG. 8, the recess 37 is constituted by an aperture which is open at the circumferential edge of the head 34' of the bush 34. Thus, by changing the bushes 34, the fixing bridge 22 can be used with scraper-chain conveyors having different dimensions. This increases the versatility of the this fixing bridge. A further increase in versatility is possible owing to the provision of two alternative holders 33 for mounting the bush 34 of each fixing bridge 22.

We claim:

1. In a mineral mining installation including a conveyor and at least one pair of roof support units with advance mechanisms connected to the goaf side of the conveyor, an elongate fixing bridge adapted to be secured to the goaf side of said conveyor between said advance mechanisms, said bridge having a first connector adjacent to one end thereof and a pair of second connectors adjacent to the opposite end thereof, said first connector lying on a longitudinal axis of said bridge and including means for accepting a block anchoring arrangement located between said advance mechanisms, and said second connectors being vertically off-set above and below said longitudinal axis and each including means for accepting a vertically inclined partial longwall anchoring arrangement extending beyond said advance mechanisms.

2. A fixing bridge according to claim 1, wherein each second connector is provided with an aperture.

3. A fixing bridge according to claim 1, wherein the fixing bridge includes a generally rectangular metal plate.

4. A fixing bridge according to claim 3, wherein the two second connectors are symmetrically disposed with respect to a central longitudinal axis of the metal plate.

5. A fixing bridge according to claim 3, wherein two laterally-spaced holders are provided on the fixing bridge between the first connector and second connectors.

6. A fixing bridge according to claim 5, wherein each of the holders is constituted by a bore passing through the metal plate.

7. A fixing bridge according to claim 6, wherein the bores are disposed along the central longitudinal axis of a metal plate.

8. A fixing bridge according to claim 5, further comprising a bush mounted in one of the holders.

9. A fixing bridge according to claim 8, wherein the bush is provided with an enlarged head portion, and wherein the head portion is provided with a recess.

10. A fixing bridge according to claim 9, wherein the recess in the head portion of the bush is arranged centrally on the head portion.

11. A fixing bridge according to claim 9, wherein the recess in the head portion of the bush is off-set from the centre thereof, and opens out on to the edge of the head portion.

12. A fixing bridge according to claim 9, wherein the bush is provided with a spigot extending from its head portion, the spigot carrying a removable fixing ring.

13. A fixing bridge according to claim 3, further comprising attachment means for attaching the fixing bridge to a channel section of a scraper-chain conveyor.

14. A fixing bridge according to claim 13, wherein the connectors are provided on one side of the metal plate, and the attachment means is provided on the other side of the metal plate.

15. A fixing bridge according to claim 13, wherein the attachment means is constituted by two pairs of claws arranged to grasp a rail attached to a channel section of a scraper-chain conveyor, one pair of claws being fixedly attached to the fixing bridge, and the other pair of claws being detachably fixed to the fixing bridge.

* * * * *